US005163879A

United States Patent [19]

Black

[11] Patent Number: 5,163,879

[45] Date of Patent: Nov. 17, 1992

[54] TORCHES FOR JUGGLING

[76] Inventor: Allen Black, P.O. Box 41, Blackville, S.C. 29817

[21] Appl. No.: 701,444

[22] Filed: May 15, 1991

[51] Int. Cl.[5] ..... A63J 23/00

[52] U.S. Cl. ..... 472/66; 482/109; 431/255

[58] Field of Search ..... 44/519, 540; 472/66; 482/109; 431/255

[56] References Cited

U.S. PATENT DOCUMENTS

| | | | |
|---|---|---|---|
| 668,599 | 12/1901 | Creelman | 482/109 X |
| 744,348 | 11/1903 | Hurst | 482/109 X |
| 1,496,028 | 6/1924 | Scott . | |
| 1,963,345 | 5/1934 | Zwilling . | |
| 2,503,754 | 4/1950 | Mari | 472/66 |
| 4,502,465 | 3/1985 | Yoshinaga et al. | 431/255 X |

*Primary Examiner*—Richard E. Chilcot, Jr.
*Attorney, Agent, or Firm*—Michael A. Mann

[57] ABSTRACT

A torch for juggling comprising a hollow, elongated body with a wick at one end surrounded by a wire reinforcement, a spark-generating mechanism carried within the body, and a pushbutton located on the end opposite the wick to operate the spark-generating mechanism, thereby igniting any fuel held by the wick. The spark-generating mechanism is preferably a piezoelectric spark generator with an electrode that passes through the hollow interior of the body and emerges on the outside and just below the wick so that the electrode and the wire reinforcement are close enough for a spark to jump the gap and ignite the fuel. The torch can be lighted simply by pushing the pushbutton just before the start of the juggling or during juggling.

12 Claims, 2 Drawing Sheets

TORCHES FOR JUGGLING

BACKGROUND OF THE INVENTION

1. Field of the Invention

The present invention relates to torches for juggling. In particular, the present invention relates to torches with built-in flame ignition systems for use in juggling.

2. Discussion of Background

Juggling is an ancient and worldwide art. The ancient Egyptians, the Romans and American Indians are known to have juggled. Currently, amateurs and professionals alike juggle balls, rings, clubs, plates, boxes, sticks, and hats. Of these, it is said that the hardest objects to juggle are clubs, which have elongated bodies with an enlarged portion near one end, a knob at the other end and a handle area therebetween. In addition to being thrown into the air and caught, the clubs are rotated or flipped about an axis perpendicular to the long axis of the club. Usually, a club is flipped once per throw. The club is thrown and caught from the center of the handle and the flipping of the club is done with the wrists or forearms depending on the weight and number of the clubs; when juggling a greater number of clubs, each club is thrown higher into the air to provide more time to catch and throw the other clubs before the first must be caught.

A typical finish, or end maneuver, to a series of juggling throws using clubs is to throw one club so that it makes a double flip; then shift the other clubs to one hand, leaving the other hand free to catch the final, doubly-flipped club.

Jugglers sometimes juggle torches, which are generally club-shaped and are flipped during juggling. Torches have a fuel reservoir and wick at one end instead of an enlarged portion. Juggling torches is dramatic, especially on a darkened stage. The torches are dipped in fuel, usually gasoline, and then the first club is lighted with an ordinary cigaretter lighter or by passing it through a flame set up on stage. The remaining torches are lighted from the first, then they are juggled by the performer.

Clubs are typically made of a wood dowel core with a molded exterior of polyethylene. The knobs may be molded of dense foam to reduce the possibility of injury or damage just in case they are dropped. Torches are similar in construction to clubs except for a section of metal tubing near one end and the wire-reinforced wick mounted on the metal tubing. It is impartant to have a well-balanced club and to have each club in a set of clubs equally balanced. The clubs should be easy to flip once, so they should not be too heavy at the enlarged end or too light.

There are of course torches for providing light, as opposed to torches for juggling, and in particular there are torches that can be lighted electrically. See for example the patent issued to H. M. Scott, U.S. Pat. No. 1,496,028 in Jun. of 1924 which contains a brief description of the use of an external battery to light a torch for providing light.

However, all juggling torches are currently lighted by some external means.

SUMMARY OF THE INVENTION

According to its major aspects and broadly stated, the present invention is a juggling club with an internal, fuel ignition system. In particular, the present juggling club is an elongate body with a first end and a second end, the first end having a wick with a reinforcing wire around it and carrying means for igniting fuel in the wick. Preferably, the elongate body is hollow and contains within it an electric spark generating device, such as a piezoelectric igniter. The igniter has an electrode that emerges from the body just below, and spaced apart from, the wick. The igniter is operated by a button carried on a second end. When the button is pressed, the spark flies between the electrode and the wire reinforcement on the wick. The spark ignites the fuel.

The fuel ignition system is the most important feature of the present juggling club. With an internal ignition system, the need to use an external ignition source is eliminated. Thus, a torch according to the present invention can be ignited simply by pressing a pushbutton on the torch itself. Further, the torch may be ignited by someone skillful in the art of juggling while being juggled. A double flip of one torch allows an extra moment in the juggling sequence, enough time to press the pushbutton of one of the instant torches still held in hand. The torch may thus be lighted between the time a first torch is thrown and the time it must be caught. A group of three (or more) such torches can be thrown sequentially high enough so that there is time for all to be lighted and all caught in time. All three torches can then be lighted during juggling for dramatic effect.

Using an electric spark generator, preferably a piezoelectric igniter, in combination with the wire-reinforcement of the wick to ignite the fuel is another important feature of the present invention. The wire thus serves two purposes: it reinforces the wick and it provides a convenient conductor to which the spark can jump from the electrode. Furthermore, the electric igniter is easily activated by pushing a button and the button can be located in the end cap or on the side of the handle of the torch.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
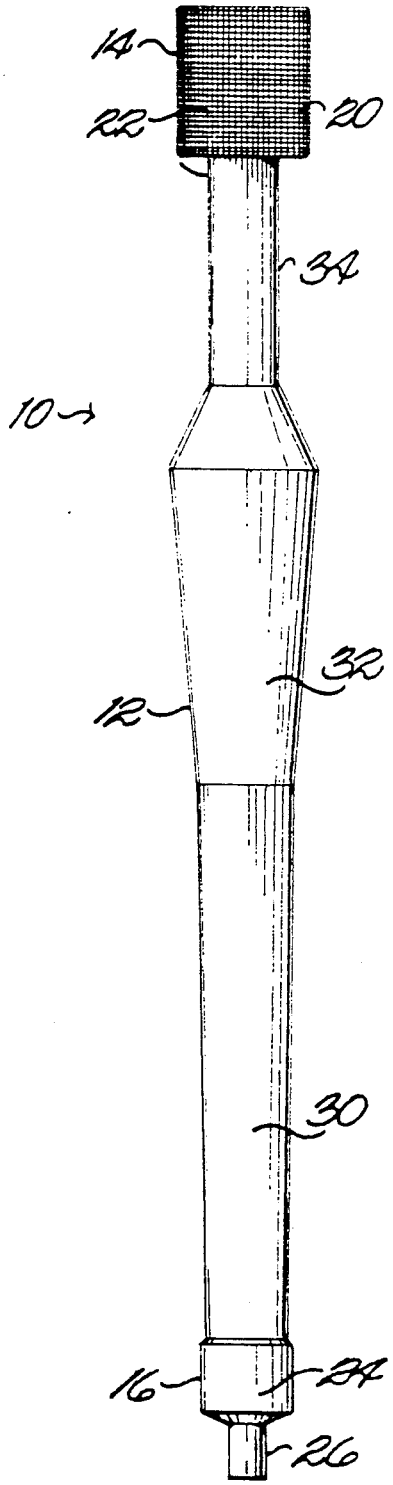
FIG. 1 is a side view of a juggling torch according to a preferred embodiment of the present invention.
Figure 2:
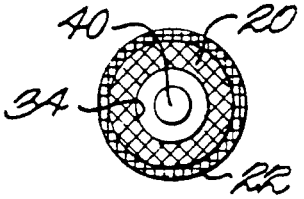
FIG. 2 is a top view of the torch of FIG. 1.

Referring now to FIG. 1, there is illustrated a side view of a torch 10 according to the present invention. The torch comprises an elongate body 12 having a first end 14 and a second end 16. First end 14 carries a wick 20 reinforced with a conductor such as a wire mesh 22, as shown in FIGS. 1 and 2, preferably copper wire mesh.

Figure 3:
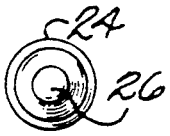
FIG. 3 is a bottom view of the torch of FIG. 1.

Second end, as illustrated in FIG. 1 and 3 in the preferred embodiment illustrated, has a rubber knob 24 and an igniter pushbutton 26.

Between first end 14 and second end 16 is, in sequence, a handle portion 30, an enlarged portion 32 and a metal portion 34. Handle portion 30 and enlarged portion 32 are preferably made of a comfortable, lightweight material such as polyethylene and shaped similarly to that of conventional torches. Handle portion 30 is for grasping torch 10 in juggling and in handling generally. Enlarged portion 32 helps to establish the balance point and the orientation of torch 10. Metal portion 34, being closet to wick 20 is exposed to greater heat than handle portion 30 or enlarged portion 32 and is preferably made of metal so that it does not burn and dissipate the heat more quickly.

Figure 4:
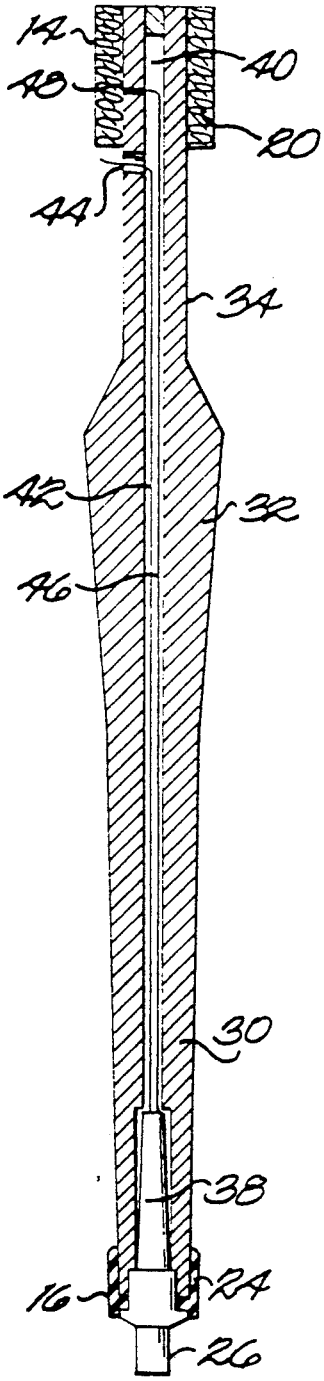
FIG. 4 is a cross sectional view of the torch of FIG. 1.
Figure 5:
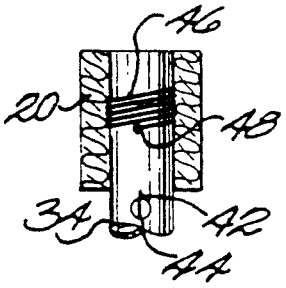
FIG. 5 is a detailed view of the top of the torch of FIG. 1 with the reinforced wicking partially cut away to show the ground wire.

As will be seen in FIG. 4, body 12 is hollow and has a channel 40 therein. In second end 16 is fitted a piezo-electric igniter 38 as is commonly used for gas grills and the like. Pushbutton 26 operates igniter 38 by producing mechanical impact which causes a short-lived electric potential across a piezo-electric material, as is well-known. The potential follows an electrode 42 to first end 14 where a first hole 44 is formed just below but in spaced relation to wick 20 (see FIG. 5). Electrode 42 emerges from body through first hole 44 and is insulated throughout its length from metal portion 34. A conductor 46 from piezo-electric igniter is attached to metal portion 34 to ground it. Conductor 46 also penetrates metal portion 34 through a second hole 48 and is secured by wrapping it about metal portion 34 several times.

In use, torch 10 is ignited by first immersing wick 20 into fuel such as gasoline or other flammable liquid that can be ignited by a spark. The pushbutton 26 is pressed to generate a spark across the gap between electrode 42 and wire mesh 22. Only one of the torches to be juggled need be of the type illustrated and described; the remainder can be conventional juggling torches so long as they are equivalently balanced. The remaining torches can be lighted from the first. Alternatively, each torch to be juggled can be made according to the present invention.

Torches according to the present invention can be ignited during juggling. A torch can be thrown into the air while a second torch can be ignited by pressing the pushbutton. Then the second torch can be thrown into the air and a third lighted and thrown before the first torch must be caught. To provide an additional moment of time to allow for the lighting of the torches, each can be thrown higher into the air and doubly-flipped.

Pushbutton 26 can be located on the side of handle portion 30 rather than at second end 16 and can of course be a different type of switch rather than a button, for example, a lever or a slide switch. Two advantages of having a switch in the form of a pushbutton mounted on second end 16 are that the switch is not likely to interfere with juggling and secondly, the torch may be lighted by bouncing it off the floor or other hard surface rather than by pressing the switch with the hand or fingers.

It will be apparent to those skilled in the art that many changes and substitutions can be made to the preferred embodiment herein described without departing from the spirit and scope of the present invention as defined by the appended claims.

What is claimed is:

1. A juggling torch, comprising:

an elongate body having a first and a second end;

wick means for holding a quantity of fuel, said wick means carried by said elongate body near said first end;

means for igniting said fuel in said wick means, said igniting means carried by said body; and a switch in operative connection with said igniting means and carried by said body at said second end.

2. The juggling torch as recited in claim 1, wherein said body is hollow and said igniting means is carried within said body.

3. The juggling torch as recited in claim 1, wherein said wick means further comprises:

a wick; and conductive reinforcing proximate to said wick.

4. The juggling torch as recited in claim 3, wherein said igniting means further comprises:

an electrode in spaced relation to said reinforcing; and means for generating a spark between said electrode and said reinforcing.

5. The juggling torch as recited in claim 4, wherein said generating means is a piezo-electric igniter.

6. A juggling torch, comprising:

an elongate body having a first and a second end;

a wick carried by said elongate body near said first end for holding a quantity of fuel;

a conductor reinforcing said wick;

an electrode in spaced relation to said conductor; and means for generating a spark between said electrode and said conductor, said spark igniting said fuel, said generating means carried by said body; and a switch positioned at said second end and in operational connection with said generating means.

7. The torch as recited in claim 6, wherein said generating means is a piezo-electric igniter.

8. The torch as recited in claim 6, wherein said body is hollow and said generating means is carried within said body, said body having a hole near said wick and said electrode emerging from within said body through said hole.

9. The torch as recited in claim 8, wherein at least a portion of said body is made of metal, said at least a portion including said first end, and said conductor is grounded to said at least a portion.

10. A method for using at least two juggling torches, at least one of said juggling torches comprising an elongate body having a handle and a wick at one end of said handle for carrying a quantity of fuel and means for igniting said fuel, said igniting means operated by a switch on said at least one juggling torch, said method comprising the steps of:

throwing a first of said at least two juggling torches into the air while holding said at least one juggling torch; and pressing said switch of said at least one juggling torch to ignite said fuel.

11. The method as recited in claim 10, wherein said at least one juggling torch comprises three juggling torches and said method further comprises the steps of:

throwing said ignited juggling torch into the air;

pressing said switch of a second juggling torch to ignite said fuel;

throwing said second ignited juggling torch into the air;

pressing said switch of a third juggling torch to ignite said fuel; and throwing said third ignited juggling torch into the air.

12. The method as recited in claim 10, wherein said first of said at least two juggling torches is thrown high enough so that said at least one juggling torch can be ignited and thrown into the air before said first of said at least two juggling torches must be caught.

* * * * *